United States Patent [19]

Waibel

[11] 4,388,006

[45] Jun. 14, 1983

[54] PRINTING RIBBON CARTRIDGE

[75] Inventor: Helmut K. Waibel, Fremont, Calif.

[73] Assignee: Durango Systems, Inc., San Jose, Calif.

[21] Appl. No.: 239,981

[22] Filed: Mar. 3, 1981

[51] Int. Cl.[3] ..... B41J 32/00; B41J 32/02

[52] U.S. Cl. ..... 400/195; 400/196; 400/208

[58] Field of Search ..... 400/195, 196, 196.1, 400/194, 207, 208, 234

[56] References Cited

U.S. PATENT DOCUMENTS

| | | | |
|---|---|---|---|
| 3,871,507 | 3/1975 | Perry et al. | 400/208 |
| 3,974,906 | 8/1976 | Lee et al. | 400/208 X |
| 3,989,132 | 11/1976 | Carson, Jr. | 400/195 |
| 3,994,383 | 11/1976 | Best | 400/196.1 |
| 4,058,197 | 11/1977 | West | 400/234 X |
| 4,130,367 | 12/1978 | Guerrini et al. | 400/195 |
| 4,161,270 | 7/1979 | Casey | 400/195 X |
| 4,277,187 | 7/1981 | Rello | 400/208 X |
| 4,293,234 | 10/1981 | Yonkers et al. | 400/196.1 |

*Primary Examiner*—Edgar S. Burr
*Assistant Examiner*—Charles A. Pearson
*Attorney, Agent, or Firm*—Thomas E. Schatzel

[57] ABSTRACT

An improved, U-shaped printing ribbon cartridge adapted for use with either film or woven printing ribbons of widely varying thicknesses. The printing ribbon feeds from one terminal end of the cartridge, across the open mouth of the "U" wherein it may be contacted for printing and into the other terminal end of the cartridge. Within the base of the U-shaped cartridge, located to one side thereof, the ribbon passes between a toothed driving wheel and a meshing, toothed pinch wheel for advancing the ribbon under tension. The pinch wheel is pivotably mounted and spring loaded against the driving wheel. Bearings located about both terminal ends of the toothed segment of the driving wheel are received by apertures formed in opposite walls of the cartridge. The driving wheel may be rotated from outside the cartridge by a splined shaft inserted thereinto or turned manually by a conically-shaped terminal end thereof. A ribbon storage compartment extending almost the full length of the base of the U-shaped cartridge stores either the bulk of a continuous loop of a woven ribbon or the spent portion of a film ribbon. Located at the end of the storage compartment opposite to the toothed wheels is either a supply roll of film ribbon or a mobius assembly for cloth ribbon. An aperture formed through a wall of the ribbon cartridge, closed by the mobius forming assembly, permits sensing the end of ribbon condition for cartridges filled with film ribbon.

10 Claims, 8 Drawing Figures

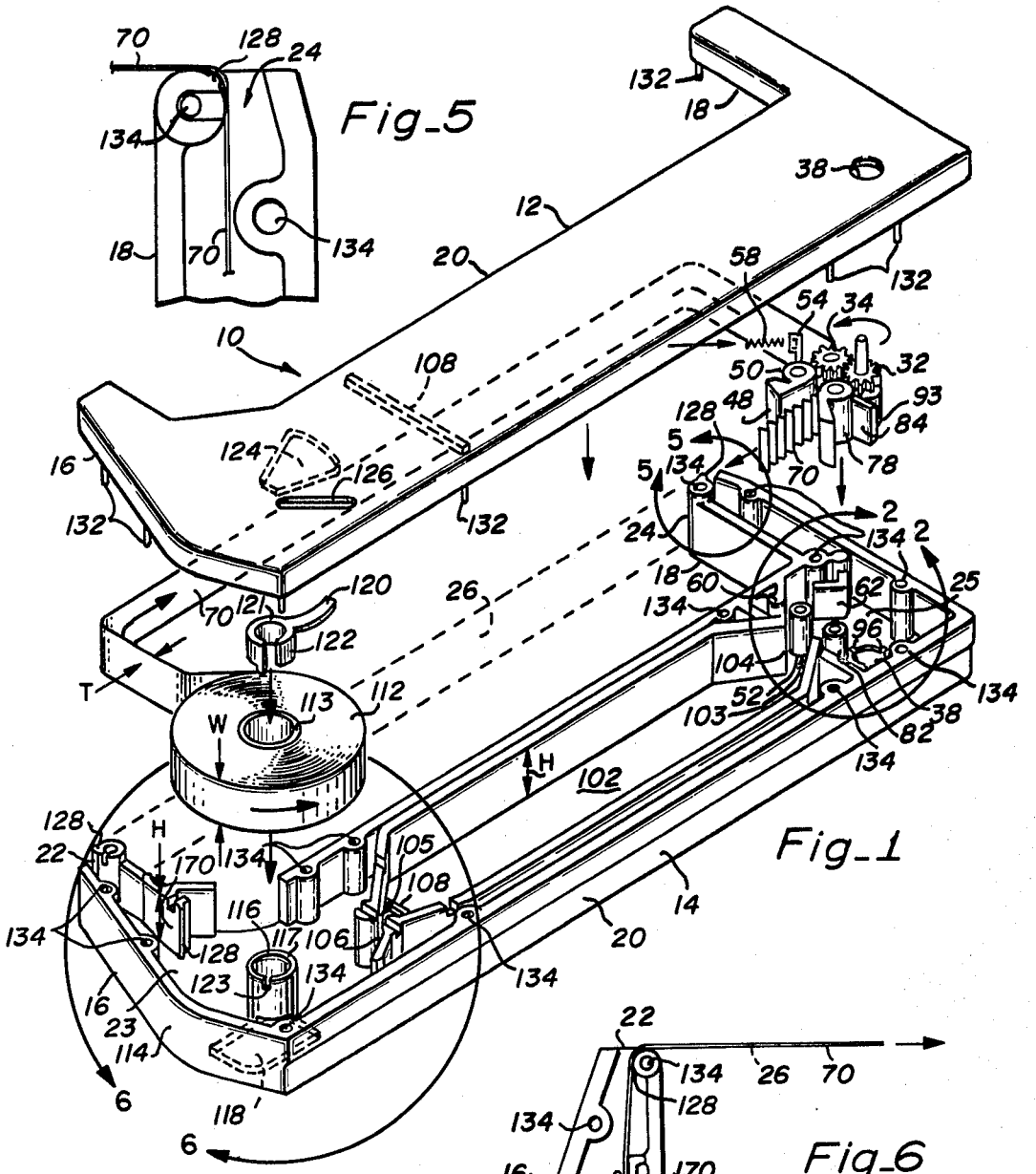
Fig_5
Fig_1
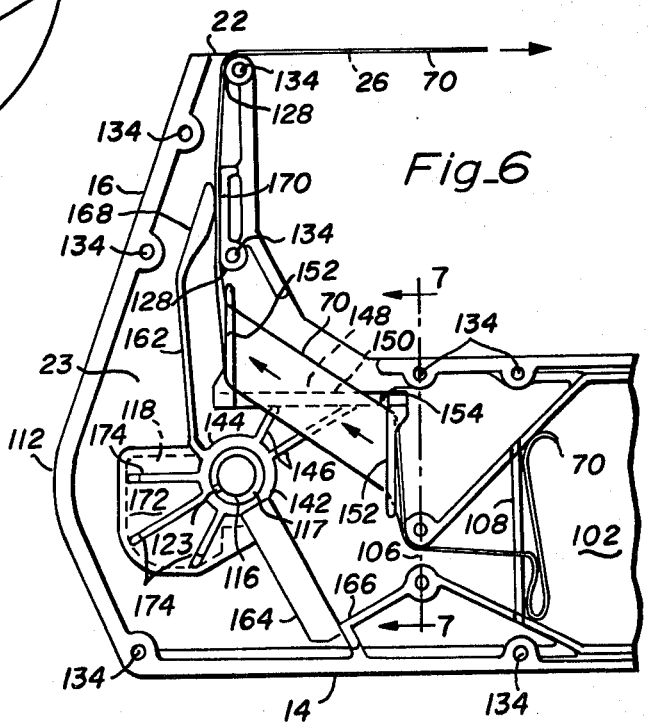
Fig_6
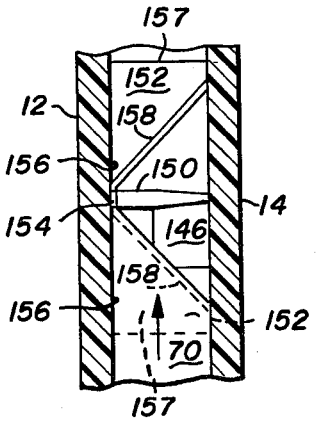
Fig_7

PRINTING RIBBON CARTRIDGE

BACKGROUND OF THE INVENTION

1. Field of the Invention

The present invention relates generally to mechanical printing and more particularly to assemblies which contain, guide and advance a printing ribbon.

2. Description of the Prior Art

Currently U-shaped printing ribbon cartridge assemblies are widely used with impact printers. In such cartridges, a printing ribbon feeds from a ribbon feed aperture located at a projecting terminal end of an arm of the U-shaped cartridge. The ribbon thus exposed then follows a path across the open mouth of the U-shaped cartridge and reenters the cartridge at another location through a ribbon return aperture located in the projecting terminal end of its other arm. When installed in an impact printer, a print head moves back and forth along the length of ribbon spanning the open mouth of the U-shaped cartridge between the arms. Located on the opposite side of the exposed ribbon from the print head is the surface of a platen past which a web of material to be printed may pass. Thus arranged, motion of print head elements toward the platen cause points on the exposed length of printing ribbon to contact mark the web of material. Located within the base of the U-shaped cartridge, between the projecting arms and opposite to the open mouth, are a ribbon storage compartment and means for guiding and advancing a printing ribbon.

A printing ribbon spanning the open mouth of the cartridge is advanced by a pair of meshing toothed wheels located within the base toward the end closest to the point at which the ribbon reenters the cartridge. These wheels are adapted for rotation within the cartridge by circular, radial bearings formed about both of their respective terminal ends. These radial bearings are received and rotatably supported in the cartridge's walls by circular apertures at fixed locations. A ribbon contained within such a cartridge is guided from the point of return into the cartridge along a path passing between these wheels. Thus, by properly rotating one of the wheels, the ribbon may be advanced under tension across the open portion of the U-shaped cartridge. Thus far, desipite the fact that thin, high quality, single pass printing ribbons fabricated from solid film material are well known in the impact printing art, wire matrix impact printers having used cartridges containing only ribbon fabricated from thick, porous, woven material. Previously it has been impossible to use printing ribbon fabricated from solid film material in these cartridges either because they lack space to store a sufficient quantity of solid film material or because of the increased expense associated with having separate cartridge types for ribbons fabricated respectively from woven, porous fabric material and from solid film material. Generally woven ribbons are relatively thick having a thickness between 0.003 and 0.006 inches and film ribbons are relatively thin having a thickness between 0.0003 and 0.001 inches.

Since these cartridges have been only useful with woven ribbons and since such ribbons may be used repeatedly and because this cartridge structure does not permit reversing the direction of ribbon travel, ribbons used in these cartridges are formed into endless loops. Formed into such loops, the woven ribbon is guided from the meshing toothed wheels along a path passing through the base of the U-shaped cartridge to the point at which it is fed out. In order to increase the amount of ribbon which such a cartridge may contain, they are fabricated with a ribbon storage compartment within the base portion of the U-shape. The ribbon storage compartments are formed with two apertures positioned at opposite ends thereof. One aperture is located immediately adjacent to the toothed wheels to receive the ribbon immediately after it passes therebetween. The other aperture is located near the far end of the base of the "U" so that the ribbon may pass immediately to the cartridge exit point upon leaving the storage compartment.

Within the storage compartment, the ribbon follows a serpentine path back and forth across the compartment's width. The ribbon is arranged along this meandering path to permit the cartridge to store a much longer length of ribbon. To facilitate feeding the ribbon into and out of the compartment, its end walls are arranged in a V-shape pointing toward the respective apertures. To assure uniform feeding of the ribbon from its serpentine arrangement within the storage compartment, the walls of the compartment adjacent to the ribbon's edges are formed with a slightly raised rib crossing between the V-shaped walls pointing toward the ribbon's exit aperture. The opposing surfaces of these ribs are spaced at a distance across the storage compartment which is less than the width of the ribbon. Thus, in passing between these ribs, the ribbon's edges are frictionally engaged and the ribbon must bend slightly. Thus, these ribs constrain the ribbon's serpentine path to the region between the storage compartment's entry aperture and the location of these ribs. Along the ribbon's entire path outside of this region of the storage compartment, the ribbon is under tension until it reaches the toothed wheel. Therefore, the ribbon's path outside of this region is essentially planar except at locations in which it passes around the cartridge's ribbon guiding members.

Further, because both sides of a woven ribbon may be used for printing, the endless loops used in these cartridges are generally formed into a mobius strip; i.e. a continuous, closed loop having only a single surface which may be formed by joining opposite terminal ends of a length of flat, flexible material. Cartridges used with a mobius strip ribbon must contain a guide element along the ribbon's path which directs the ribbon along a path which reverses the cartridge walls to which its edges are adjacent. Thus, opposite side surfaces of a fixed location on a ribbon so formed and guided are alternately adjacent to the web to be printed when passing across the open mouth of the U-shaped cartridge. Because the mobius guide element frictionally engages the ribbon and therefore increaes the tension therein, it is usually located along the ribbon's path between the exit from the storage compartment and the point at which the ribbon feeds from the cartridge.

SUMMARY OF THE PRESENT INVENTION

An object of the present invention is to provide an improved printing ribbon cartridge for use with a printing ribbon fabricated from either thick, porous, woven material or thin, solid film material.

Another object is to provide an improved printing ribbon cartridge drive capable of advancing under tension a printing ribbon fabricated from either thick, porous, woven material or thin, solid film material.

Another object is to provide an improved printing ribbon cartridge drive which opposes manual translation of a printing ribbon in a direction opposite to its advancement direction.

Another object is to provide an improved printing ribbon cartridge adapted for use with a printing ribbon formed either into a roll or into an endless loop.

Briefly, a preferred embodiment of a printing ribbon cartridge of the present invention includes a toothed driving wheel meshing with a toothed pinch wheel located toward one side of a base of the cartridge. The toothed driving wheel has cylindrical, radial bearings formed about both its terminal ends. These bearings are received and rotatably supported within fixed, circular apertures formed in the cartridge's opposing walls. The meshing, toothed pinch wheel is not rotatably supported by similar radial bearings received by fixed apertures in the cartridge's walls. Rather, the meshing toothed pinch wheel of the cartridge of the present invention is rotatably supported by planar end bearings and recessed radial bearings formed intermediate the terminal ends of its toothed length. The planar end bearings contact the interior surfaces of opposing cartridge walls, while the radial bearings are rotatably supported whtin a forked yoke of a pinch wheel support lever. The pinch wheel support lever is further formed with a right, circular cylindrical pivot aperture displaced to one side of the pinch wheel. This aperture rotatably secures the support lever to the cartridge's wall by being positioned about a rod-shaped pin projecting therefrom. Force applied tangentially to the support lever by a coil spring is coupled to the pinch wheel, thereby urging it into meshing engagement with the drive wheel. This coil spring is held in compression between an interior surface of the cartridge's wall and a projecting terminal end of an arm formed on the pinch lever. Thus secured within the cartridge, the mating pinch wheel and driving wheel provide sufficient frictional engagement to advance a printing ribbon fabricated from solid film material as well as those fabricated from porous, woven material.

To prevent an advancing printing ribbon from jamming, the surfaces of the forked yoke are shaped to guide the ribbon away from the supported pinch wheel. For the same reason, the driving wheel is formed with radial troughs located intermediate the terminal ends of its toothed length. Positioned within these troughs are curved fingers of a ribbon guide. The ribbon guide is supported within the cartridge by a pin projecting from its wall. Thus supported, the ribbon guide is restrained from rotating about the pin by a projecting arm received within a notched rib extending from the cartridge wall. The opposed curved surfaces of the forked yoke and the ribbon guide fingers immediately adjacent to an advancing ribbon form a V-shaped channel opening toward a ribbon entry aperture of the ribbon storage compartment.

When disposed within the cartridge of the present invention, a printing ribbon may be translated along its length by rotating the toothed driving wheel. This wheel is adapted at one terminal end for rotation from outside the cartridge by a splined shaft inserted therein. The other terminal end of this wheel projecting outward from the cartridge wall beyond the radial bearing is shaped to form a conical knob. The conical shape of this knob's surface requires application of a longitudinal force toward the cartridge to achieve manual rotation of the driving wheel. Within the cartridge, projecting from the terminal end surface of the toothed segment of the driving wheel furthest from the conically shaped knob and spaced regularly about the radial bearing projecting therefrom are ramped cogs. Similarly, mating ramped cogs are also formed projecting inward from the immediately adjacent cartridge wall about the aperture which receives the radial bearing. When the driving wheel is rotated to advance the ribbon under tension, these ramped cogs urge the driving wheel to translate along its axis of rotation away from the cartridge wall. Conversely, when manual advancement of the ribbon by the conically shaped knob is attempted, the longitudinal force applied to the driving wheel moves the unramped, square faces of these cogs into opposing engagement. Thus, this cartridge opposes manual rotation of the driving wheel in a direction opposite to that in which the ribbon is advanced under tension. This feature is essential to prevent accidental manual disengagement of a terminal end of a ribbon not formed into a continuous loop from the toothed wheels. Further, it serves to prevent excessive backward feeding of a ribbon which might result in mechanical jamming within the cartridge.

The base of the U-shaped cartridge located at the end of the ribbon storage compartment furthest from its entry aperture is adapted to receive a roll of printing ribbon. Thus, the cartridge is formed with an arcuate side wall bowing away from the ribbon storage compartment. Further, the cartridge is formed with a rod-shaped ribbon pin projecting from its lower wall between the arcuate side wall and the ribbon storage compartment. To permit sensing when a roll of printing ribbon rotatably secured about the ribbon pin has been consumed, an aperture is formed through the cartridge wall immediately adjacent to the ribbon pin's point of attachment thereto. Further, to provide frictional drag for establishing tension in an advancing ribbon spring having a split ring formed at one terminal end is keyed to the projecting end of the ribbon pin. The leaf spring is received within a recess in the cartridge wall and contacts the edge of the ribbon wound on the roll. The split ring frictionally engages an interior surface of a spool about which the ribbon is wound. Tangential force applied to the leaf spring by the rotating ribbon roll opens the split ring thereby increasing frictional engagement with the spool's interior surface. As the ribbon is consumed the tangential force decreases thereby reducing the drag applied to the ribbon by the frictional engagement between the split ring and the spool. When used with a roll of printing ribbon, the ribbon storage compartment intermediate the toothed wheels and the roll is used solely for storing the length of spent ribbon.

If the cartridge of the present invention is used with a continuous, loop ribbon formed into a mobius strip rather than with a roll, a mobius assembly is secured within the cartridge about a ribbon pin. The mobius assembly includes two ribbon tilting guides formed in the shape of isoceles right triangles. A terminal end of the hypotenuse of each of these guides is respectively secured to a common edge of a rectangularly-shaped ribbon guide bar at opposite terminal ends of its length. The guides are secured with their triangular surfaces essentially perpendicular to the length of the ribbon guide bar. Thus located, the triangular faces are positioned with their respective attitudes aligned essentially parallel to the width of the guide bar and with their bases aligned essentially perpendicular thereto and positioned furthest therefrom. When viewed inward along a direction parallel to the ribbon pin's axis, the ribbon tilting guides and the ribbon guide bar establish a reversed image of the letter "Z." When viewed along the length of the guide bar, the hypotenuses of the triangularly shaped guides respectively form the arms of a letter "V" having its junction at the common edge of the guide bar to which the guides are secured. Thus, the ribbon tilting guide's hypotenuses are positioned to cross diagonally between the cartridge's opposing walls. The mobius assembly is formed so that the mobius guide is disposed transversely across a direct path between the exit aperture of the ribbon storage compartment and the cartridge's ribbon feed aperture. Further, the length of ribbon guide bar is aligned essentially parallel to the ribbon's path across the open mouth of the U-shaped cartridge. Further, the triangularly-shaped guide closest to the ribbon storage compartment points from the guide bar toward the ribbon compartment's exit aperture while the other triangular guide points from the guide bar toward the cartridge's ribbon feed aperture.

A path for a ribbon may be established around this mobius guide so an edge of the ribbon disposed immediately adjacent to one wall of the cartridge upon entry to the mobius guide is disposed immediately adjacent to an opposing cartridge wall upon exit therefrom as follows. Upon passing through the ribbon storage compartment's exit aperture, the ribbon is guided along a path adjacent to the surface of the closest triangularly shaped guide which is also farthest from the cartridge's ribbon pin. As this path crosses the guide's hypotenuse, it progressively curves under and around it. This curvature around the diagonally-positioned hypotenuse directs the ribbon's path so it then crosses above the common edge of the ribbon guide bar to which the triangularly-shaped ribbon tilting guides are secured. Continuing across the guide bar, the ribbon's path again curves under and around the diagonally-positioned hypotenuse of the second triangularly-shaped guide located closest to the cartridge's ribbon feed aperture. After passing that guide's hypotenuse, the ribbon's path is then guided directly away from the cartridge's ribbon pin toward its ribbon feed aperture.

As guided along this path, the ribbon's edge which first encounters the hypotenuse of the triangularly-shaped guide curves therearound at the open mouth of the "V" formed by the hypotenuses when viewed along the length of the guide bar. This same ribbon edge, after passing over the guide bar, curves under the second triangularly-shaped guide's hypotenuse at its junction with the guide bar's common edge; i.e. at the junction of the "V"'s two arms. Thus, that edge of the ribbon has been guided from a position immediately adjacent to a wall of the cartridge upon entry to the mobius assembly to a position immediately adjacent to the opposing wall upon exit therefrom.

Since the mobius guide of the present invention introduces lower frictional engagement along the ribbon's path than other types of guides performing the same function, the mobius assembly is further formed with a flexible ribbon break arm. The ribbon break arm extends outward along the ribbon's path between the mobius guide and the cartridge's ribbon feed aperture. This arm is loaded to press the ribbon against an interior surface of the cartridge's wall by means of a second more rigid arm projecting from the opposite side of the mobius assembly. The terminal end of this second arm farthest from the cartridge's ribbon pin engages a rib projecting inward from the cartridge's wall. The location of this rib and the stiffness of the break arm controls the amount of frictional drag thus added to the ribbon's path. the mobius assembly is formed with a flat plate projecting outward from the ribbon pin and positioned immediately adjacent to the cartridge's wall. This plate covers and closes the aperture used to sense when a roll of ribbon has been consumed. Thus, when the cartridge contains a continuous endless loop of ribbon, it always appears to be full.

An advantage of the printing ribbon cartridge of the present invention is that it may be used with a printing ribbon fabricated from either thick, porous, woven material or thin, solid film material.

Another advantage of the printing ribbon cartridge drive of the present invention is that it can advance under tension a printing ribbon fabricated from either thick, porous, woven material or thin, solid film material.

Another advantage of the printing ribbon cartridge drive is that it prevents inadvertent manual translation of a printing ribbon in a direction opposite to its advancement direction.

Another advantage of the printing ribbon cartridge is that it may be used with a printing ribbon formed either into a roll or into an endless loop.

These and other objects of the present invention will no doubt become obvious to those of ordinary skill in the art after having read the following detailed description of the preferred embodiment as illustrated in the various drawing figures.

IN THE DRAWING

FIG. 1 is an exploded perspective view of a printing ribbon cartridge in accordance with the present invention;

FIG. 5 is a plan view of the printing ribbon cartridge taken along the line 5—5 of FIG. 1 showing the printing ribbon path through the ribbon return aperture;

FIG. 6 is a plan view of the printing ribbon cartridge containing a mobius assembly and an endless, looped printing ribbon taken along the line 6—6 of FIG. 1;

FIG. 7 is a cross-sectional view of the modius assembly taken along the line 7—7 of FIG. 6.

DETAILED DESCRIPTION OF THE PREFERRED EMBODIMENT

Figure 2:
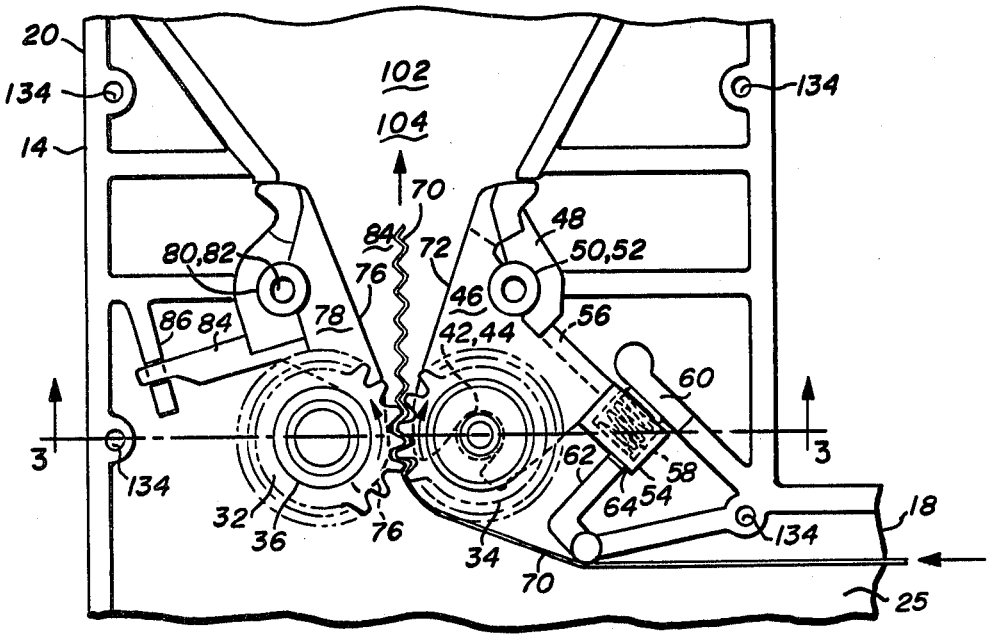
FIG. 2 is a plan view of the printing ribbon cartridge taken along the line 2—2 of FIG. 1.

FIG. 1 is an exploded view of an improved, U-shaped printing ribbon cartridge in accordance with the present invention and referred to by the general reference character 10. The cartridge 10 includes a cover 12 and a mating pan 14. The cartridge 10, as assembled by mating the cover 12 to the pan 14, is in the shape of the letter "U" having a first arm 16 and a second arm 18 projecting from opposite terminal ends of a base 20. The first arm 16 is formed with a ribbon feed aperture 22 located at a terminal end 23 farthest from the base 20. Similarly, the second arm 18 is formed with a ribbon return aperture 24 located at a terminal end 25 farthest from the base 20. Thus formed, the ribbon feed aperture 22 and the ribbon return aperture 24 establish a ribbon path 26 across the open mouth of the U-shaped cartridge 10 between the terminal ends 23, 25 of the arms 16 and 18 farthest from the base 20.

Figure 3:
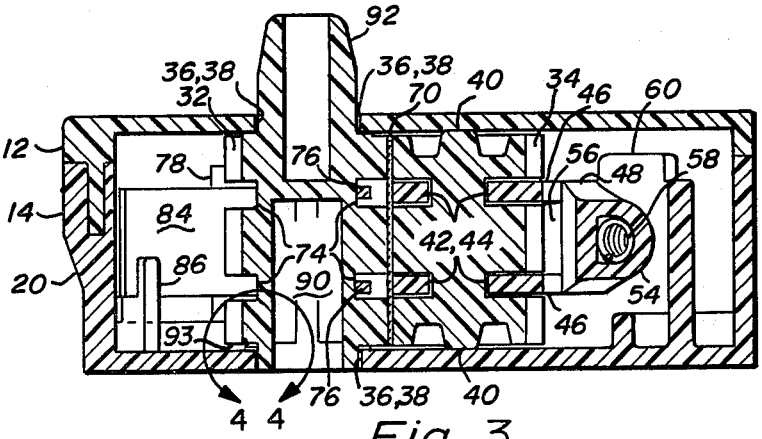
FIG. 3 is a cross-sectional view of the printing ribbon cartridge taken along the line 3—3 of FIG. 2.

Located within the base 20 of the cartridge 10 at terminal end 25 from which the second arm 18 projects is a toothed, ribbon driving wheel 32. Meshing with the driving wheel 32 is a toothed pinch wheel 34. Referring now to FIGS. 2 and 3, the driving wheel 32 is formed with cylindrical, radial bearings 36 about both its terminal ends. The bearings 36 are respectively received and rotatably supported within fixed, circular apertures 38 formed respectively through the cover 12 and the pan 14. The pinch wheel 34 is rotatably positioned between the opposing surfaces of the cover 12 and the pan 14 by planar, end bearings 40 projecting outward from its toothed length. Further, the pinch wheel 34 includes two recessed, radial bearings 42 formed intermediate its terminal ends and positioned symmetrically about the midpoint of its toothed length. The radial bearings 42 are rotatably supported by bearing surfaces 44 formed on a forked yoke 46 of a pinch wheel support lever 48. The pinch wheel support lever 48 further includes a pivot aperture 50 displaced to one side of the pinch wheel 34. The pinch wheel support level 48 is rotatably secured within the cartridge 10 by a rod-shaped pin 52 projecting from the interior surface of the pan 14.

The pinch wheel support lever 48 also includes a cup-shaped spring retainer 54 located at the end of an arm 56 projecting outward from the pivot aperture 50 between the sides of the forked yoke 46. The cup-shaped spring retainer 54 retains a coil spring 58 held in compression against the surface of a rib 60. Force thus applied tangentially to the pinch wheel support lever 48 with respect to the pin 52 urges the pinch wheel 34 into meshing engagement with the driving wheel 32. Since the pinch wheel 34 need only move a few thousandths of an inch to adjust to printing ribbons of various thicknesses, the range of movement for the pinch wheel support lever perpendicular to the rib 60 is limited by a restraining rib 62 located adjacent to the spring retainer 54. Thus, an end surface of the restraining rib 62 and the side surface of the rib 60 form a notch 64 in which the cup-shaped retainer 54 and the coil spring 58 are retained.

Thus aligned and engaged, the wheels 32 and 34 may be used to grasp and longitudinally translate a printing ribbon 70. Thus, as shown in FIG. 2, when the driving wheel 32 is rotated counterclockwise, the printing ribbon 70 advances upward between the teeth of the wheels 32 and 34. Since the force applied to the ribbon 70 by the wheels 32 and 34 deforms it, the ribbon 70 has a tendency to remain entrained upon one of the wheels 32 or 34, thereby jamming the mechanism. For this reason, a surface 72 of the forked yoke 46 immediately adjacent to the ribbon 70 are shaped to guide it out of the toothed wheel 34. For this very same reason, the driving wheel 32 is formed with two radial troughs 74 aligned with the radial bearings 42 of the pinch wheel 34. Positioned within the troughs 74 are curved fingers 76 of a ribbon guide 78. As with the pinch wheel support lever 48, the ribbon guide 78 is supported by an aperture 80 surrounding a rod-shaped pin 82 projecting outward from the surface of the pan 14. Since the tooth wheel 32 is retained at a fixed location within the cartridge 10, the ribbon guide 78 is restrained in a fixed position by a projecting arm 84 received within a notched rib 86. The curved surfaces 72 of the forked yoke 46 opposed by the surfaces of the curved fingers 76 establish a V-shaped guide 84 to direct the path of the ribbon 70 leaving the toothed wheels 32 and 34 toward the center of the base 20 of the U-shaped cartridge 10.

Figure 4:
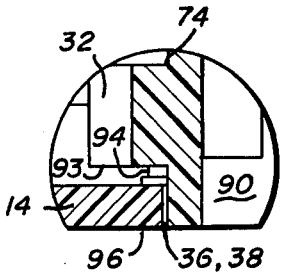
FIG. 4 is an enlargement of the area 4—4 of the cross-sectional view of FIG. 3 showing the mating cogs.

The driving wheel 32 is adapted for rotation by means of an interior, cruciform-shaped chamber 90 and a conically-shaped knob 92 projecting beyond the surface of the cover 12. Thus, the driving wheel 32 is adapted to be mechanically rotated by a splined shaft mating with and inserted into the chamber 90. The surface of the knob 92 has a conical shape so that manual rotation of the driving wheel 32 requires the application of a longitudinal force toward the interior of the cartridge 10 in addition to a tangential, rotary force. Within the cartridge 10, projecting from a terminal end 93 of the toothed length of the driving wheel 32 farthest from the knob 92 and spaced regularly about the radial bearing 36 projecting therefrom are ramped cogs 94, shown in FIG. 4. Similar, mating ramped cogs 96 are also formed projecting inward from the immediately adjacent surface of the pan 14 about the aperture 38. The mating ramps of the cogs 94 and 96 are formed so they urge the terminal end 93 of the toothed length of the driving wheel 32 away from the surface of the pan 14 when the wheel 32 is rotated in the direction which translates the ribbon 70 toward the middle of the base 20. Conversely, when manual advancement of the ribbon 70 by the conically-shaped knob 92 is attempted, the longitudinal force applied to the driving wheel 32 moves the unramped, square faces of the cogs 94 and 96 into opposing engagement. Thus, the cogs 94 and 96 oppose manual rotation of the driving wheel 32 in a direction opposite to that in which the ribbon 70 is advanced. This feature of the cartridge 10 is essential to prevent accidental manual disengagement of the terminal end of a ribbon 70 not formed into a continuous loop from the wheels 32 and 34. Further, this feature serves to prevent excessive backward feeding of a ribbon 70 which might result in mechanically jamming the wheels 32 or 34.

Referring again to FIG. 1, within the central portion of the base 20 of the U-shaped cartridge 10, extending almost its entire length, is a ribbon storage compartment 102. Located at the terminal end 103 of the ribbon storage compartment 102 closest to the wheels 32 and 34 is a ribbon entry aperture 104. The surfaces of the entry aperture closest to the wheels 32 and 34 are shaped to fit closely with the surfaces of the pinch wheel support lever 48 and the ribbon guide 78 so the ribbon 70 may not enter therebetween and jam. Formed at a terminal end 105 of the ribbon storage compartment 102 farthest from the wheels 32 and 34 is a ribbon exit aperture 106. The walls of the ribbon storage compartment 102 immediately adjacent to the apertures 104 and 106 are shaped to form a V respectively pointing toward the aperture 104 and 106 in order to facilitate feeding the ribbon 70 into and out of the storage compartment 102. Projecting from the interior surface of the pan 14 and the top 12 within the storage compartment 102 adjacent to the ribbon exit aperture 106 are opposing, blocking ribs 108. The ribs 108 restrain the advancement of the ribbon 70 as it progresses toward the ribbon exit aperture 106.

The cartridge 10 is adapted to receive a roll 112 of printing ribbon 70 having a width "W" and wound about a cylindrical, flangeless spool 113 by an arcuate side wall 114 bowing away from the ribbon exit aperture 106. Further, the pan 14 is formed with a rod-shaped ribbon pin 116 projecting from its interior surface for receiving the spool 113. Formed in the wall of the pan 14 immediately adjacent to the ribbon pin 116 and farthest from a projecting terminal end 117 is a sensing aperture 118. The aperture 118 permits sensing when the roll 112 of printing ribbon 70 has been consumed. Contacting the roll 112 of printing ribbon 70 along the surface immediately adjacent to the cover 12 is a curved, leaf spring 120. The leaf spring 120 is secured at one terminal end 121 by means of a tabbed, split ring 122 keyed to a notch 123 in the projecting terminal end 117 of the ribbon pin 116 which also frictionally engages a mating, interior surface of the spool 113. Further, the interior surface of the cover 12 is formed with a recess 124 in the shape of an annular arc to receive the leaf spring 120. As the roll 112 rotates it applies a tangential force to the leaf spring 120 urging it to open within the spool 113 thereby increasing the frictional engagement between them. As the ribbon 70 is consumed from the roll 112, this tangential force decreases thereby reducing the drag applied to the ribbon 70 by the frictional engagement between the mating surfaces of the split ring 122 and the spool 113. The cover 12 also includes a slotted aperture 126 aligned along a radius of the roll 112 for visual inspection of the quantity of ribbon remaining.

The cartridge 10 is preferably used with rolls 112 of high-quality, single pass printing ribbons 70 fabricated from solid film material. Printing ribbons 70 fabricated from such material generally have a thickness "T" lying between 0.0003 and 0.001 inches. Conversely, printing ribbons 70 fabricated from porous, woven material are generally much thicker, having a thickness "T" between 0.003 and 0.006 inches. Thus, a roll 112 wound from a thin, film printing ribbon 70 may contain up to ten times as much ribbon 70 as a corresponding roll 112 wound from thick, woven printing ribbon 70. Regardless of the type of printing ribbon 70 to be used in the cartridge 10, all of its surfaces between the opposing interior surfaces of the pan 14 and the cover 12 which are contacted by the ribbon 70 are formed to have a height, denoted by the letter "H," which is slightly greater than the width "W" of the ribbon 70. Thus, the ribbon 70 may contact only a continuous surface extending between opposing surfaces of the pan 14 and the top 12 as it is advanced under tension from the roll 112 out the first arm 16 and through the feed aperture 22, along the path 26, through the return aperture 24 and down the second arm 18 to the toothed wheels 32 and 34. The similar surfaces of the ribbon storage compartment 102 are also formed to have a height "H." Thus, when used with a roll 112 of printing ribbon 70, the opposing ribs 108 within the storage compartment 102 bar the advancement of spent printing ribbon 70 toward the exit aperture 106.

Because the thin printing ribbon 70 fabricated from solid film material is extremely compliant, it may establish a large frictional engagement with smooth, curved interior surfaces of the cartridge 10 which it contacts under tension. This engagement with such smooth, curved surfaces may be so large as to prevent advancement of the thin film ribbon 70 even by the forceful engagement of the pinch wheel 34 and the ribbon driving wheel 32. A roughened surface on these curved interior surfaces contacted under tension by the thin film ribbon 70 prevents the establishment of this frictional engagement. Thus the preferred embodiment of this invention includes small bumps 128, shown in FIG. 5, projecting outward from and formed along the height of curved surfaces contacted under tension by the ribbon 70 such as those at the ribbon feed aperture 22 and the ribbon return aperture 24. The bumps 128 need not extend far enough from the curved surfaces to prevent all further contact of the ribbon 70 therewith. However, the bumps 128 must project far enough to prevent the formation of a frictional engagement of the ribbon 70 around the entire distance of the curved surface.

The cover 12 is secured to the pan 14 by a plurality of pins 132 distributed about its periphery as shown in FIG. 1. The pan 14 is adapted to receive the pins 132 by means of an equal plurality of mating apertures 134 formed about its periphery. The mating surfaces of the cover 12 and the pan 14 other than those which may be contacted by the ribbon 70 meet along a planar surface located part way across its height "H."

If the cartridge 10 is used with a continuous, looped printing ribbon 70 formed into a mobius strip rather than with a roll 112, a mobius assembly, shown in FIG. 6, is secured within the pan 14 about the ribbon pin 116. The mobius assembly 142 includes a ring-shaped collar 144 positioned about the ribbon pin 116. Projecting outward from the collar 144 opposite to the sensing aperture 118 are ribs 146 supporting a reversed Z-shaped mobius guide 148. The mobius guide 148 is formed by a rectangularly-shaped ribbon guide bar 150 to opposite terminal ends of which are secured triangularly-shaped ribbon tilting guides 152. The ribbon tilting guides 152 are formed in the shape of isosceles right triangles with their triangular surfaces aligned essentially perpendicular to the length of the ribbon guide bar 150. As shown in FIG. 7, the triangularly-shaped tilting guides 152 are connected to the guide bar 150 along a common edge 154 with their respective altitudes 156 aligned essentially parallel to the width of the guide bar 150. The bases 157 of the triangular faces 152 are aligned essentially perpendicular to the width of the guide bar 150 and positioned farthest therefrom. Thus, when viewed along the length of the guide bar 150, the hypotenuses 158 of the triangularly-shaped guides 152 respectively form the arms of a "V" having a junction at the common edge 154 of the guide bar 150. This orientation of the triangularly-shaped tilting guides 152 cause the respective hypotenuses 158 to cross diagonally between opposing interior surfaces of the cover 12 and the pan 14. Referring again to FIG. 6, it is apparent that the mobius guide 148 is positioned transversely across a direct path between the ribbon exit aperture 106 and the ribbon feed aperture 22. Located in this position, the length of the ribbon guide bar 150 is aligned essentially parallel to the path 26 of a ribbon 70 spanning the open mouth of the U-shaped cartridge 10 between terminal ends of the arms 16 and 18. Lastly, the triangularly-shaped guide 152 closest to the ribbon storage compartment 102 points from the guide bar 150 toward the exit aperture 106 while the other triangular guide 152 points from the guide bar 150 toward the ribbon feed aperture 22.

Figure 8:
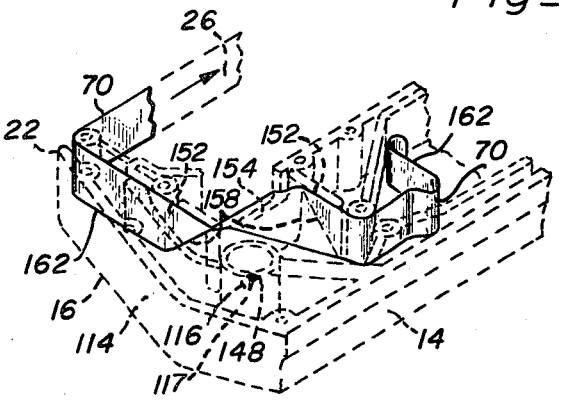
FIG. 8 is a perspective view of the printing ribbon cartridge of FIG. 6 showing the path of the printing ribbon about the mobius assembly.

With the aid of FIG. 8, it may be seen that a path may be established around the mobius guide 148 wherein an edge 162 of the ribbon 70 positioned adjacent to the cover 12 upon entry to the mobius guide 148 is positioned adjacent to the opposing wall of the pan 14 upon exit therefrom. That path is as follows. Upon passing through the exit aperture 106, the ribbon 70 is guided adjacent to the surface of the immediately adjacent tilting guide 152 farthest from the pin 116. As this path crosses the hypotenuse 158 of the guide 152, the ribbon 70 progressively curves under and around that edge. This curvature of the path directs the ribbon 70 toward the guide bar 150 which it then crosses above the common edge 154. Continuing across the common edge 154, the path of the ribbon 70 again curves under and around the diagonally positioned hypotenuse 158 of the tilting guide 152 pointing toward the feed aperture 22. Upon passing the second tilting guide 152, the ribbon is then guided directly to the exit aperture 22.

Since the mobius guide 148 has a low frictional engagement with the ribbon 70, the mobius assembly 142, as shown in FIG. 6, further includes a flexible brake arm 162 extending outward from the collar 144 toward the ribbon feed aperture 22. Projecting outward from the opposite side of the collar 144 is a more rigid second arm 164. The second arm 164 engages a rib 166 projecting from an interior surface of the pan 14. The location of the rib 166 and the relative stiffness of the brake arm 162 control the amount of friction created by clamping the ribbon 70 between a projecting brake end 168 of the arm 162 and a brake surface 170 of the pan 14. Note that the curved portion of the brake surface 170 is formed with a bump 128 to prevent excessive frictional engagement with film ribbons 70. However, since the printing coating of currently available film ribbons 70 will generally be abrasively removed through contact with the brake end 168 of the brake arm 162, such ribbons 70 should not be used with the mobius assembly 142. Also note that the slotted aperture 126 is positioned in the cover 12 so as to be closed by the arm 164. Thus the cartridge 10 appears to be full of ribbon whenever a mobius assembly 142 is installed therein. Further, the mobius assembly 142 is formed with a flat plate 172 projecting outward from the collar 144 immediately adjacent to and covering the sensing aperture 118. Three radially disposed ribs 174 project outward from the collar 144 to reinforce the plate 172. Thus, the plate 172 covers and closes the aperture 118 used for sensing when a roll 112 of ribbon has been consumed. Thus, when the cartridge 10 contains a continuous, endless loop of ribbon 70 guided around the mobius assembly 142 it is sensed as full.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. An improved, U-shaped printing ribbon cartridge for use with printing ribbons, the cartridge being adapted to enclose the entire length of a printing ribbon other than a length exposed over an open end for printing, the cartridge including a ribbon feed aperture located at a first terminal end of a base of the U-shaped cartridge near said open end and a ribbon return aperture located at a second terminal end of the base near said open end for guiding a length of ribbon along a path across said open end, and a cartridge cover secured to said cartridge base by a plurality of pins distributed about a periphery of said cover, said base adapted to receive said pins by means of an equal plurality of mating apertures formed about said base periphery, said cover and said base mating surfaces meeting along a planar surface located partially across the cartridge height, and a ribbon storage compartment located within the base and having a ribbon entry aperture formed about a third terminal end of said ribbon storage compartment for admitting a length of ribbon thereto wherein the improvement comprises:

a toothed, ribbon driving wheel for advancing a ribbon under tension, the driving wheel being located within the cartridge intermediate said ribbon return aperture and said third terminal end of said ribbon storage compartment, the driving wheel being rotatable about an axis fixed with respect to the cartridge;

mechanical means directly engaged to the cartridge and a driving wheel chamber and manual means connected to the driving wheel to permit rotation of the driving wheel from outside the cartridge;

a spring loaded, toothed pinch wheel rotatably supported within the cartridge and urged into meshing engagement with the driving wheel; and a mobius forming means for guiding a length of ribbon along a path comprised of a Z-shaped mobius guide formed by a rectangular shaped ribbon guide bar aligned essentially parallel to said ribbon path spanning said open end of said U-shaped cartridge and a triangularly-shaped ribbon tilting guide secured to each opposite terminal end of a common edge of said guide bar, wherein said opposing tilting guides are shaped as isosceles right triangles with triangular surfaces aligned essentially perpendicular to the length of said ribbon guide bar and altitudes of said triangles aligned essentially parallel to the width of said guide bar and bases of said triangles aligned essentially perpendicular to the width of said guide bar wherein said isosceles right triangles each have a hypotenuse which forms one arm of a "V" having a junction at said common edge of said guide bar causing said hypotenuses, to cross diagonally between opposing interior surfaces and further the mobius guide positioned transversely across a direct path between said ribbon exit aperture of the ribbon storage compartment and said ribbon feed aperture with an edge of said ribbon disposed immediately adjacent to one wall of the cartridge at an entry to said mobius forming means and disposed immediately adjacent to an opposing wall of said cartridge upon exit therefrom, said mobius forming means being rigidly but removably secured to a ribbon pin within the cartridge outside of a fourth terminal end of the ribbon storage compartment.

2. The improved printing ribbon cartridge of claim 1 wherein;

the pinch wheel has radial bearings formed intermediate its terminal ends, the pinch wheel being rotatably supported by a curved surface of a forked yoke of a pinch wheel support lever mating with said radial bearings thereof, said support lever being secured within the cartridge to be rotatable about a pivot aperture axis parallel to and separated from a stud-shaped pin projecting from the cartridge base about which the pinch wheel is rotatable, the pinch wheel being urged into meshing engagement with the driving wheel by a coil spring disposed between an interior surface of the cartridge and a surface of said pinch wheel support lever and further including a cup-shaped spring retainer disposed at an end of an arm projecting outward from said pivot aperture between the sides of said forked yoke, said spring retainer restraining said coil spring in compression against a first rib of the cartridge, the movement of said spring retainer intermediate said support lever and said first rib limited by a second restraining rib forming a groove in which said cup-shaped retainer and said spring are restrained to accomodate various ribbon thickness.

3. The improved printing ribbon cartridge of claim 2 wherein;

the ribbon driving wheel is rotatably supported by cylindrical, radial bearings positioned about both terminals ends of the toothed length thereof, said bearings being respectively received by and rotatably supported within fixed, circular apertures formed through opposite walls of the ribbon cartridge.

4. The improved printing ribbon cartridge of claim 3 wherein;

the driving wheel has radial troughs therein intermediate the terminal ends of said toothed length thereof and said chamber located within said driving wheel is cruciform shaped and further comprising, a driving wheel ribbon guide supported by an aperture surrounding a rod-shaped pin projecting outward from the base within the cartridge, said ribbon guide restrained in a fixed position by a projecting arm received within a notched rib and including curved fingers which mate with said radial troughs of the driving wheel, said curved fingers of the ribbon guide and said curved surface of the forked yoke of said pinch wheel support lever form a V-shaped guide for advancing ribbon away from the toothed wheels after the ribbon has passed therebetween.

5. The improved printing ribbon cartridge of claim 4 wherein;

said cruciform shaped chamber and the driving wheel are adapted to be mechanically rotated by a splined shaft mating with and inserted into said chamber at a terminal end of said toothed length of the driving wheel inside a radial bearing farthest from a conically-shaped knob, said shaft extending out of the cartridge wall and wherein the driving wheel may be manually rotated by said knob extending out of the cartridge and further including, ramp cog means projecting from said terminal end of said toothed length of the driving wheel farthest from said conically-shaped knob and spaced regularly about said radial bearing and mating ramp cog means projecting inward from said base surface of the cartridge about one of said circular apertures, said mating ramp means urging said terminal end of the drive wheel away from said base surface when the wheel is rotated in a direction translating the ribbon toward the ribbon storage compartment and opposing rotation of the driving wheel in a direction opposite to that in which a ribbon is advanced under tension by said splined shaft or said conically-shaped knob by urging a plurality of unramped, square faces of said cogs into opposing engagement.

6. The improved printing ribbon cartridge of claim 1 wherein;

said ribbon storage compartment further includes a ribbon exit aperture formed at said fourth terminal end of the storage compartment, said exit aperture being located at the opposite end of the storage compartment from said ribbon entry aperture and further comprising, a continuously, endless length of fabric printing ribbon formed into a mobius strip wherein said Z-shaped mobius forming means permits both sides of said ribbon to be utilized for printing, and guiding means for guiding the printing ribbon along a path outward from said ribbon storage compartment through said ribbon exit aperture of said ribbon storage compartment, through said Z-shaped mobius forming means, across roughened bumps projecting outward from and formed along the height of interior curved surfaces of the cartridge guiding means contacted under tension by the ribbon to prevent ribbon cohesion to said guiding means, through said ribbon feed aperture of the cartridge, outward from the cartridge, across said open end of the U-shaped cartridge, back inward to the cartridge through said ribbon return aperture, across said bumps projecting outward from the interior curved surfaces of the cartridge, between the toothed wheels and thence again back toward through said ribbon entry aperture and across a pair of blocking ribs located at said fourth terminal end of said ribbon storage compartment.

7. The improved printing ribbon cartridge of claim 6 further including;

a sensing aperture formed through the base of the cartridge for sensing when a roll of printing ribbon as may be contained therein reaches the end of said roll and, a flat plate formed to the Z-shaped mobius forming means and reinforced by three radially disposed ribs projecting outward from a ring-shaped collar immediately adjacent to said sensing aperture for closing said sensing aperture and, a rigid second arm formed to said ring-shaped collar of the Z-shaped mobius forming means closing a slotted aperture positioned within the cover of the cartridge and aligned along a radius of the roll for sensing when a roll of printing ribbon has reached the end of said roll.

8. The improved printing ribbon cartridge of claim 7 further including;

a flexible friction brake arm extending outward from said ring-shaped roller disposed along said ribbon path between said ribbon exit aperture of the ribbon storage compartment and said ribbon feed aperture of the U-shaped cartridge and including a brake surface with a curved portion formed with a bump to prevent excessive frictional engagement with the ribbon for opposing translation of the printing ribbon with respect to the cartridge when the Z-shaped mobius forming means is utilized and wherein, said rigid second arm projecting outward from said ring-shaped collar engaging an interior rib of the cartridge and opposing said brake arm, the location of said interior rib and the stiffness of said brake arm control the friction created on the ribbon by said curved portion of said brake surface.

9. An improved, U-shaped printing ribbon cartridge for use with printing ribbons, the cartridge being adapted to enclose the entire length of a printing ribbon other than a length exposed over an open end for printing, the cartridge including a ribbon feed aperture located at a first terminal end of a base of the U-shaped cartridge near said open end and a ribbon return aperture located at a second terminal end of the base near said open end for guiding a length of ribbon along a path across said open end, and a cartridge cover secured to said cartridge base by a plurality of pins distributed about a periphery of said cover, said base adapted to receive said pins by means of an equal plurality of mating apertures formed about said base periphery, said cover and said base mating surfaces meet along a planar surface located partially across the cartridge height, and a ribbon storage compartment located within the base and having a ribbon entry aperture formed about a third terminal end of said ribbon storage compartment for admitting a length of ribbon thereto, wherein the improvement comprises:

a toothed, ribbon driving wheel for advancing a ribbon under tension, and driving wheel being located within the cartridge intermediate said ribbon return aperture and said third terminal end of said ribbon storage compartment, the driving wheel being rotatable about an axis fixed with respect to the cartridge;

mechanical means directly engaged to the cartridge and a driving wheel chamber and manual means connected to the driving wheel to permit rotation of the driving wheel from outside the cartridge;

a spring loaded, toothed pinch wheel rotatably supported within the cartridge and urged into meshing engagement with the driving wheel;

bearing means for rotatably securing a roll of ribbon within the cartridge outside of said ribbon storage compartment, the bearing means being located about a fourth terminal end of the ribbon storage compartment opposite to said third terminal end thereof and comprised of a rod-shaped ribbon pin including a notch projecting from the cartridge interior surface for receiving a spool of ribbon;

a roll wound from a continuous length of single pass printing ribbon of a defined width, the roll wound about a cylindrical, flangeless spool by an arcuate side wall bowing away from said ribbon exit aperture and being rotatably secured about the bearing means;

guiding means for guiding the printing ribbon along a path away from the roll, across roughened bumps projecting outward from and formed along the height of interior curved surfaces of the cartridge guiding means contacted under tension by the ribbon to prevent ribbon cohesion to said guiding means, through said ribbon feed aperture, outward from the cartridge, across said open end of the U-shaped cartridge, back inward to the cartridge through said ribbon return aperture, across said bumps projecting outward from the interior curved surfaces of the cartridge, between the toothed wheels and thence inward to the ribbon storage compartment through said ribbon entry aperture terminating the travel of the spent ribbon at a pair of blocking ribs; and friction means disposed between the roll and an interior surface of the cartridge comprised of a leaf spring secured at a fifth terminal end by a tabbed split ring keyed to said notch in a projecting sixth terminal end of said rod-shaped ribbon pin, said leaf spring frictionally engaging a mating internal surface of said spool and an interior arc recess in said cartridge cover to receive said leaf spring for applying a tangential force to said leaf spring as the roll rotates increasing a frictional engagement between the rool and said spring, for opposing the rotation of the roll with respect to the cartridge, said tangential force decreasing as the ribbon is consumed from the roll thereby reducing said frictional engagement.

10. The improved printing ribbon cartridge of claim 9 wherein;

the driving wheel has radial troughs therein intermediate the terminal ends of said toothed length thereof and said chamber located within the driving wheel is cruciform shaped, said chamber and the driving wheel being mechanically rotatable by a splined shaft mating with and inserted into said chamber at a terminal end of said toothed length of the driving wheel inside a radial bearing farthest from a conically-shaped knob, said shaft extending out of the cartridge wall and wherein the driving wheel may be manually rotated by said knob extending out of the cartridge and further comprising, a driving wheel ribbon guide supported by an aperture surrounding a rod-shaped pin projecting outward from the base within the cartridge, said ribbon guide restrained in a fixed position by a projecting arm received within a notched rib and including curved fingers which mate with said radial troughs of the driving wheel, said curved fingers of the ribbon guide and a curved surface of a forked yoke of said pinch wheel support lever form a V-shaped guide for advancing ribbon away from the toothed wheels after the ribbon has passed therebetween and, the pinch wheel has radial bearings formed intermediate its terminal ends, the pinch wheel being rotatably supported by said curved surface of the forked yoke of the pinch wheel support lever mating with said radial bearings thereof, said support lever being secured within the cartridge to be rotatable about a pivot aperture axis parallel to and separated from a stud-shaped pin projecting from the cartridge base about which the pinch wheel is rotatable, the pinch wheel being urged into meshing engagement with the driving wheel by a coil spring disposed between an interior surface of the cartridge and a surface of said pinch wheel support lever and further including a cup-shaped spring retainer disposed at an end of an arm projecting outward from said pivot aperture between the sides of said forked yoke, said spring retainer restraining said coil spring in compression against a first rib of the cartridge, the movement of said spring retainer intermediate said support lever and said first rib limited by a second restraining rib forming a groove in which said cup-shaped retainer and said spring are restrained to accomodate various ribbon thicknesses, and further comprising, ramp cog means projecting from said terminal end of said toothed length of the driving wheel farthest from said conically-shaped knob and spaced regularly about said radial bearing and, mating ramp cog means projecting inward from said base surface of the cartridge about an aperture, said mating ramp means urging said terminal end of the drive wheel away from said base surface when the wheel is rotated in a direction translating the ribbon towards the ribbon storage compartment and said mating ramp means opposing rotation of the driving wheel in a direction opposite to that in which a ribbon is advanced under tension by said splined shaft or said conically-shaped knob by urging a plurality of unramped, square faces of said cogs into opposing engagement, and an aperture formed through a wall of the cartridge for sensing when the roll reaches the end of said ribbon.

* * * * *